US006439118B1

(12) United States Patent
Rudzewitz

(10) Patent No.: US 6,439,118 B1
(45) Date of Patent: Aug. 27, 2002

(54) METHOD AND DEVICE FOR MAKING-READY AND FEEDING PRINTING FORMS

(75) Inventor: Stephan Rudzewitz, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/501,761

(22) Filed: Feb. 10, 2000

(30) Foreign Application Priority Data

Feb. 10, 1999 (DE) ..... 199 05 389

(51) Int. Cl.[7] ..... B41F 27/12; B41L 47/14

(52) U.S. Cl. ..... 101/477; 101/479; 101/480; 101/415.1

(58) Field of Search ..... 101/477, 415.1, 101/483, 378, 116, 128.4, 494, 479, 480

(56) References Cited

U.S. PATENT DOCUMENTS

| | | | | |
|---|---|---|---|---|
| 5,074,212 A | * | 12/1991 | Kobler et al. | 101/477 |
| 5,309,832 A | * | 5/1994 | Merkel et al. | 101/415.1 |
| 5,413,043 A | | 5/1995 | Fuhrmann et al. | 101/415.1 |
| 5,435,242 A | * | 7/1995 | Kusch et al. | 101/477 |
| 5,809,881 A | | 9/1998 | Deschner et al. | 101/415.1 |
| 6,024,019 A | * | 2/2000 | Williams et al. | 101/477 |
| 6,308,629 B1 | * | 10/2001 | Smith | 101/477 |

FOREIGN PATENT DOCUMENTS

| | | |
|---|---|---|
| DE | 43 03 872 A1 | 10/1993 |
| DE | 43 29 125 C1 | 1/1995 |
| DE | 195 42 893 A1 | 5/1997 |
| DE | 196 17 217 A1 | 11/1997 |
| DE | 196 23 694 A1 | 12/1997 |

OTHER PUBLICATIONS

International Patent Application WO 96/35582 (Smith), dated Nov. 14, 1996.

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A method of making-ready and feeding printing forms to a form cylinder of a printing machine, wherein at least one printing form is provided in a rolled-up state in a container and is unrolled so as to be fed to the form cylinder, which comprises replaceably positioning the container on the frame of a printing unit; gripping the printing form, that is formed as a printing plate, at a leading edge thereof by a clamping device of a form cylinder, that is formed as a plate cylinder; and rotating the cylinder so as to apply the printing plate to the plate cylinder; and a device for performing the method.

9 Claims, 4 Drawing Sheets

METHOD AND DEVICE FOR MAKING-READY AND FEEDING PRINTING FORMS

BACKGROUND OF THE INVENTION

Field of the Invention

The invention relates to a method and a device for making-ready and feeding printing forms to a form cylinder of a printing machine, at least one printing form being made-ready or provided in a container in a rolled-up state and being unrolled to be fed to the form cylinder.

A method and a device of this type are disclosed in the published German Patent Document DE 43 03 872 C2. In that document, a relatively thin printing film is rolled up in a storage container, the latter is inserted into the form cylinder and the printing film is guided around the form cylinder. The end of the printing film projects into a receiving container, so that the printing film, like the film of a camera, can be conveyed onward from the storage container to the receiving container after each print job has been completed, in such a way that a new printing form rests on the form cylinder. However, a precondition for such a method and such a device is that the printing film or the printing plates likewise proposed are present as a film-like strip which is so flexible that it can be drawn around the form cylinder.

Printing plates provided for high-quality printing, however, even if they are plastic printing plates, have an excessively great stiffness or inflexibility, especially when they are intended to be used for a large print edition or to be reused. Drawing the printing film around the form cylinder, moreover, is a problem even in the case of thin, flexible printing forms. For this reason, an air cushion for this process is proposed by the cited document. Further disadvantages of this heretofore known proposal are that the operations during the application and renewal of the printing film require intensive work and lengthen the machine down or stoppage times, considerable space in the form cylinder is required in order to accommodate two rolls, the accommodation of two rolls restricts the number of jobs which can be processed without interruption, and the mass of the two rolls leads to imbalance problems. In addition, using the thin printing film and the receiver contemplated therefor, the achievement of high register accuracy for multicolor printing is not possible, because the thin printing film is deformed under the effect of force applications.

A further proposal for making-ready and feeding printing forms to a form cylinder is disclosed in the published German Patent Document DE 196 23 694 A1. Described therein is a cartridge for accommodating printing forms, which are stored flat therein. Although "printing films" are mentioned as printing forms in this document, it has transpired that flat storage of printing forms in a cartridge requires such a great stiffness of the printing forms that only metal printing plates can generally be used. Flexible printing plates, mostly plastic printing plates, such as polyester plates, which are already too stiff for the first-mentioned method and device, are not stiff enough to be stored in the cartridge. They sag and are difficult to guide. As a result, problems occur during the automatic feeding of printing plates to the plate cylinder, and during tautening or clamping on the latter.

SUMMARY OF THE INVENTION

It is accordingly an object of the invention to provide a method and a device of the type referred to in the introduction hereto wherein flexible printing plates for high-quality printing and large editions can be made-ready on the printing machine during machine operation, and simple and reliable feeding and tautening or clamping of the printing plates on the plate cylinder is possible.

With the foregoing and other objects in view, there is provided, in accordance with one aspect of the invention, a method of making-ready and feeding printing forms to a form cylinder of a printing machine, wherein at least one printing form is provided in a rolled-up state in a container and is unrolled so as to be fed to the form cylinder, which comprises replaceably positioning the container on the frame of a printing unit; gripping the printing form, that is formed as a printing plate, at a leading edge thereof by a clamping device of a form cylinder, that is formed as a plate cylinder; and rotating the cylinder so as to apply the printing plate to the plate cylinder by rotating the latter.

In accordance with another mode, the method of the invention includes returning the plate cylinder into the container, after a print job has been completed.

In accordance with a further mode, the method of the invention includes feeding a printing plate from the plate cylinder to a receiving container, after a print job has been completed.

In accordance with another aspect of the invention, there is provided a device for making-ready and feeding printing forms to a form cylinder of a printing machine, wherein at least one printing form is provided in a container in a rolled-up state and is unrollable so as to be fed to the form cylinder, comprising a receiving device for positioning the container on a frame of a printing unit so that a leading edge of a printing form formed as a printing plate is insertable into a clamping device of a form cylinder formed as a plate cylinder, the plate cylinder being rotatable for applying the printing plate to the plate cylinder.

In accordance with another feature, the device of the invention includes a rotatable guide element for guiding and pressing against the printing plate as it is being drawn onto the plate cylinder.

In accordance with a further feature of the invention, the rotatable guide element comprises two supporting rollers for pressing edge regions of the printing plates onto the plate cylinder.

In accordance with an added feature of the invention, the guide element is a roller for pressing the printing plate onto the plate cylinder.

In accordance with an additional feature of the invention, the device includes elastic rings disposed at spaced distances from one another on the roller.

In accordance with yet another feature of the invention, the guide element is automated for plate feeding and is engageable and disengageable automatically.

In accordance with yet a further feature of the invention, the container has a shaft received therein for retainingly guiding a trailing edge of a printing plate until the printing plate is removed from the container.

In accordance with yet an added feature of the invention, the container serves for accommodating a printing plate therein after a print job has been performed.

In accordance with yet an additional feature of the invention, for accommodating a printing plate in the container, a shaft received in the container for gripping a trailing edge of the printing plate after a print job has been performed, and for drawing the printing plate back into the container.

In accordance with still another feature of the invention, a drive is connected to the shaft.

In accordance with still a further feature of the invention, the drive includes a spring connected to the shaft, the spring being subjectible to tension when a printing plate is removed from the container, the printing plate being drawable back into the container by spring force after a print job has been completed.

In accordance with still an added feature of the invention, the device includes another container for accommodating a printing plate therein after a print job has been performed.

In accordance with still an additional feature of the invention, for accommodating a printing plate in the other container, a shaft is received in the other container for gripping a trailing edge of a printing plate after a print job has been performed, and drawing the printing plate into the other container.

In accordance with another feature of the invention, the device includes a drive connected to the shaft received in the other container.

In accordance with a concomitant feature of the invention, the drive includes a spring connected to the shaft received in the other container, the spring being subjectible to tension when a printing plate is removed from the first-mentioned container, the printing plate being drawable into the other container by spring force after a print job has been completed.

With regard to the device according to the invention, the object thereof is achieved by positioning the container on the frame of a printing unit by a receiving or holding device so that the leading edge of a printing form constructed as a printing plate can be inserted into a clamping device of a form cylinder constructed as a plate cylinder, and by applying or fitting a printing plate to the plate cylinder by rotating the latter.

By the method according to the invention and the device for performing the method according to the invention, printing plates which do not have the great stiffness or inflexibility of metal printing plates can be fed reliably to a plate cylinder and can be clamped in and on the cylinder. On the other hand, these printing plates can, however, have such a great stability and, therefore, such a stiffness, that they are suitable for quality prints in large editions, and the printing plates can be clamped reliably and accurately.

The container may be constructed to accommodate one or more printing plates. The printing plates may already have been finally completed in the reproduction process and placed into the container, or it is possible to fill the container with one or more direct exposure plates for exposure in the printing machine. Because one or more printing plates lie rolled together in the container, the container is significantly more compact than a cartridge in which the printing plates lie flat. As a result, the container can be transported considerably better, and is therefore also very well suited as a transport container. In particular, it is possible for the printing plates to be placed into the container in the reproduction facility, possibly directly in the exposure device, by which the printing plate is securely protected until the removal of the printing plate in the printing machine and, as a result, any damage is ruled out. No refilling into another container, nor any removal, is necessary. In the case of direct exposure plates, the plates can be placed into the container by the manufacturer, by which the just-mentioned advantage is likewise achieved.

For the practical implementation and configuration of the container there are many possibilities. It can be configured with a round, square, hexagonal or any other shape. It can have a relatively small diameter to accommodate a relatively tightly rolled-up printing plate, or can have a large diameter for a number of printing plates or a printing plate that is rolled up less tightly. The handling of the insertion of the container into the printing machine is extremely simple and can be performed at any time, even with the machine in operation. It is merely necessary for an empty container to be removed and a new container to be inserted into the receiving or holding device. In this regard, various printing plates can be handled; these can be printing plates which are clamped only by the leading edge thereof or those which, for high quality requirements, are clamped at the leading and trailing edges and are subsequently aligned, if necessary in accurate register, on the plate cylinder. In this case it is possible to provide printing plates with a straight or bent-away trailing edge and to feed those plates to the plate cylinder. In the latter case, the trailing edge of the printing plate can be inserted automatically in a conventional manner by a pressure roller into a trailing-edge clamping device of the plate cylinder.

The method can be further improved by the fact that, after a print job has been completed, the printing plate can be returned from the plate cylinder into the container. This is primarily an expedient refinement when the container contains only one printing plate. If it contains a number of printing plates, provision can then be made that, after a print job has been completed, a printing plate is fed from the plate cylinder to a receiving or holding container, wherein the printing plate can likewise be rolled up. In this case, provision is preferably made for the receiving or holding container to be able to accommodate a number of printing plates as well.

For the purpose of securely handling the printing plates, one embodiment of the device provides for a rotating guide element to be provided which guides and presses the printing plates on the plate cylinder as the plates are drawn in. Provision can be made for the rotating guide element to be two supporting rollers which press the edge regions of the printing plates onto the plate cylinder. As a result, maximum care is given to the printing plate, because these edge regions lie outside the image area. However, provision can also be made for the guide element to be a roller which presses the printing plates onto the plate cylinder. In this case, for the careful handling of the printing plates, it is also possible for the roller to be equipped at spaced distances with resilient rings. The guide element can be brought into and out of engagement manually or under automatic control for plate feeding. In the latter case, the guide element can be connected mechanically to a pressure roller for inserting the trailing edge of the plate so that it comes out of engagement with the latter.

The container can be constructed so that it contains a shaft which guides and holds the trailing edge of the plate until the printing plate is removed from the container. The advantage of this embodiment is that the printing plate is guided better in the container and, as a result, can also be fed or removed better. When a printing plate is introduced into the container, it is possible to insert the trailing edge of the plate into the shaft and then to wind up the printing plate in the container. However, provision can also be made for the container to be opened at its end and for a shaft with a wound-up printing plate to be pushed into the container.

As described hereinbefore in relation to the method, the device of the invention can also be configured so that the container serves to accommodate a printing plate after a print job has been performed, or that another container serves to accommodate a printing plate after a print job has been performed. It is also possible for one or more printing plates to be rolled up in this holding container. The actual configuration of the container expediently depends upon whether the container is intended to contain or hold one or more printing plates.

In order to take up the printing plate after the print job has been performed, provision can be made for a shaft in the container to grip the trailing edge of the plate and then to draw the printing plate into the container. For this purpose, the shaft can be connected to a drive. If only one container is provided in order to make a new printing plate ready and to receive or hold the printing plate after the print job has been performed, the shaft can be connected to a spring which is subjected to tension when a printing plate is removed, in order then, by the spring force thus generated, to draw back or return the printing plate into the container after the print job has been completed.

Other features which are considered as characteristic for the invention are set forth in the appended claims.

Although the invention is illustrated and described herein as embodied in a method and device for making-ready and feeding printing forms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
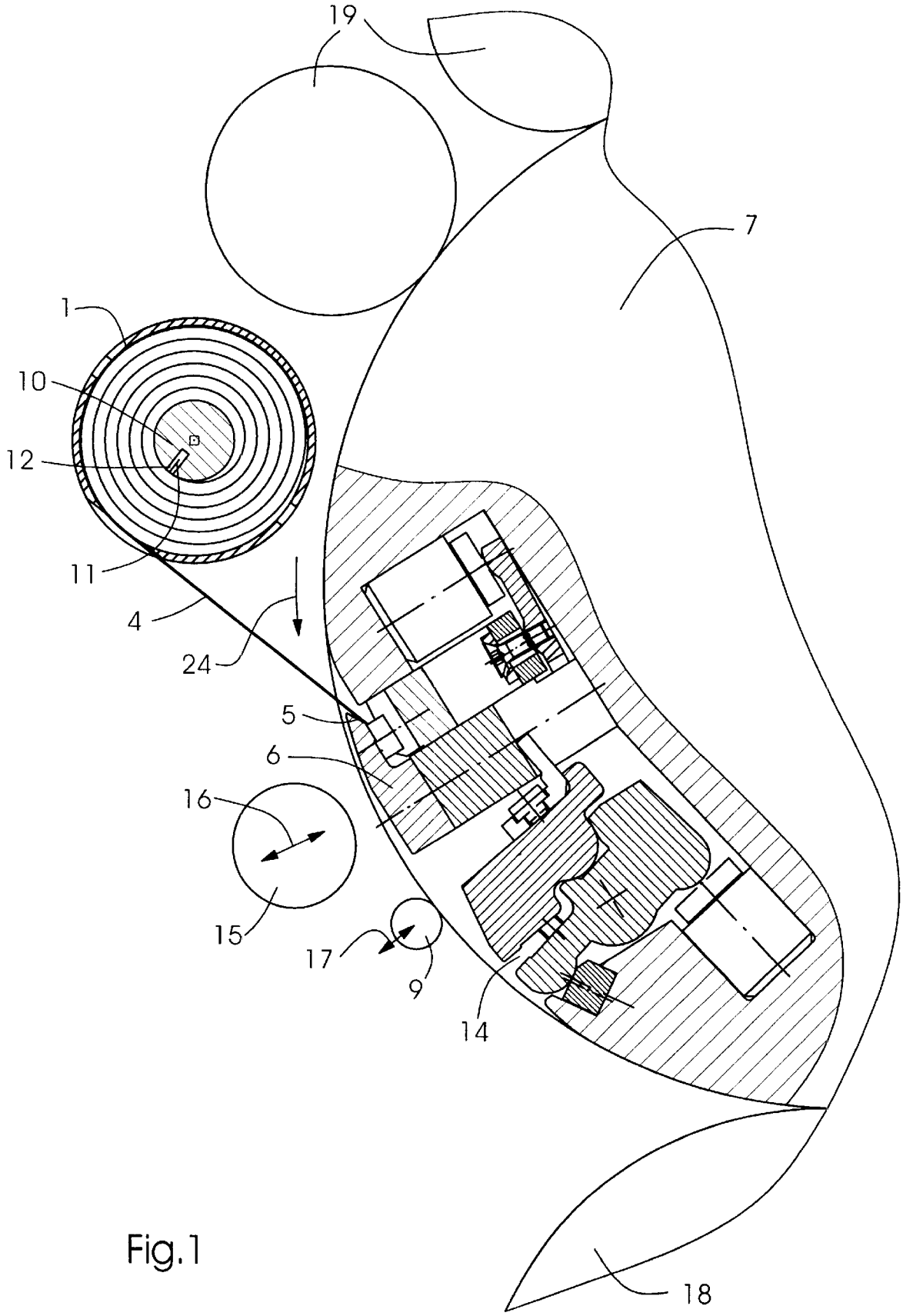
FIG. 1 is a fragmentary side elevational view, partly in section, of an exemplary embodiment of the device according to the invention.

Referring now to the drawings and, first, particularly to FIG. 1 thereof, there is shown therein an embodiment of a container and the disposition thereof in relation to a plate cylinder 7. A printing plate 4 is in a rolled-up state in the container 1, a shaft 10 holding the trailing edge 11 of the plate within a groove 12 that is formed therein. In order to feed new printing plates 4 to the plate cylinder 7, the container 1 is inserted into a printing unit 3, and a leading edge 5 of the printing plate 4 is drawn out of the container 1. The leading edge 5 of the printing plate 4 is then inserted into a leading-edge clamping device 6 of the plate cylinder 7, and clamped therein. The plate cylinder 7 is rotated in the direction of the arrow 24, the printing plate 4 being drawn out of the container 1 and wound around the plate cylinder 7. For the purpose of providing secure feeding and exact contact between the printing plate 4 and the plate cylinder 7, use is made of a guide element 9, which can be brought into and out of contact with the plate cylinder 7 in the direction of the double arrow 17. This guide element 9 can be constructed, for example, as rollers which press the edge regions of the printing plate 4 against the plate cylinder 7. Once the printing plate 4 has been wound around the plate cylinder 7, the trailing edge 11 of the plate also emerges from the container 1 and is inserted into a trailing-edge clamping device 14 by a pressure roller 15, which is movable in the direction of the double arrow 16. The trailing-edge clamping device 14 closes and, in so doing, firmly grips the trailing edge 11 of the plate, in order thereafter, with a slight pivoting movement, to clamp the printing plate 4 so that it makes firm contact with the plate cylinder 7. In FIG. 1, the position of a rubber-covered cylinder 18 and of ink applicator rollers 19 is also indicated.

Figure 4:
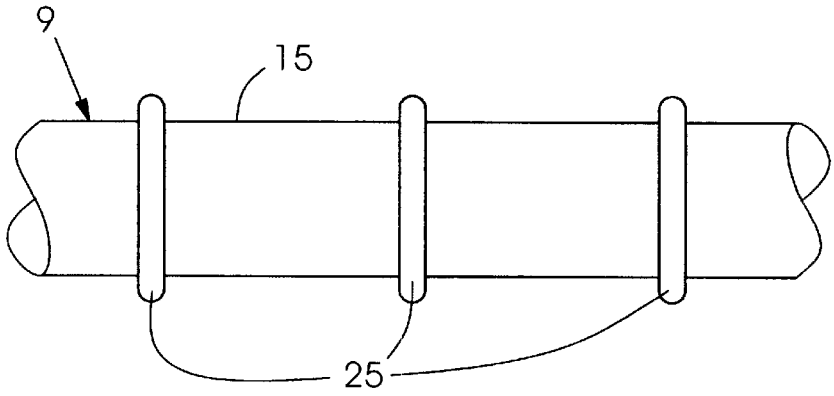
FIG. 4 is a partial front view of a guide element.

As shown in FIG. 4, the guide element 9 can include elastic rings 25 disposed at spaced distances from one another on the roller 15.

Of course, other configurations and positions of the container 1 are also possible; for example it may also be arranged underneath the pressure roller 15. It is also possible to feed printing plates 4 having a straight plate trailing edge; in this case the shaft 10 must provide a different holding device for the trailing edge 11 of the plate, and the trailing-edge clamping device 14 must likewise be appropriately configured otherwise.

Figure 5:
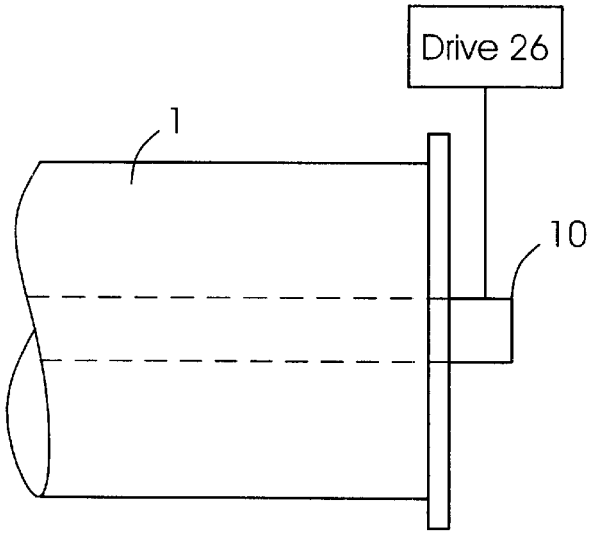
FIG. 5 is a close-up view of the drive connected to the shaft.

Fig. 5 shows a drive generally marked by reference number 26. The drive turns the shaft 10.

Figure 6:
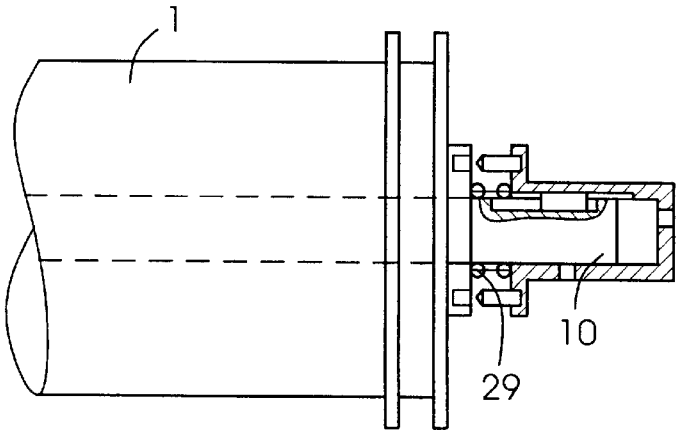
FIG. 6 is a cross-sectional view of the shaft.

FIG. 6 is a cross sectional view of the shaft 10. The drive 26 includes a spring 29 connected to the shaft 10, The spring is subjectible to tension when a printing plate 4 is removed from the container 1. A deployed printing plate 4 is drawn back into the container 1 by spring force after a print job has been completed.

Figure 2:
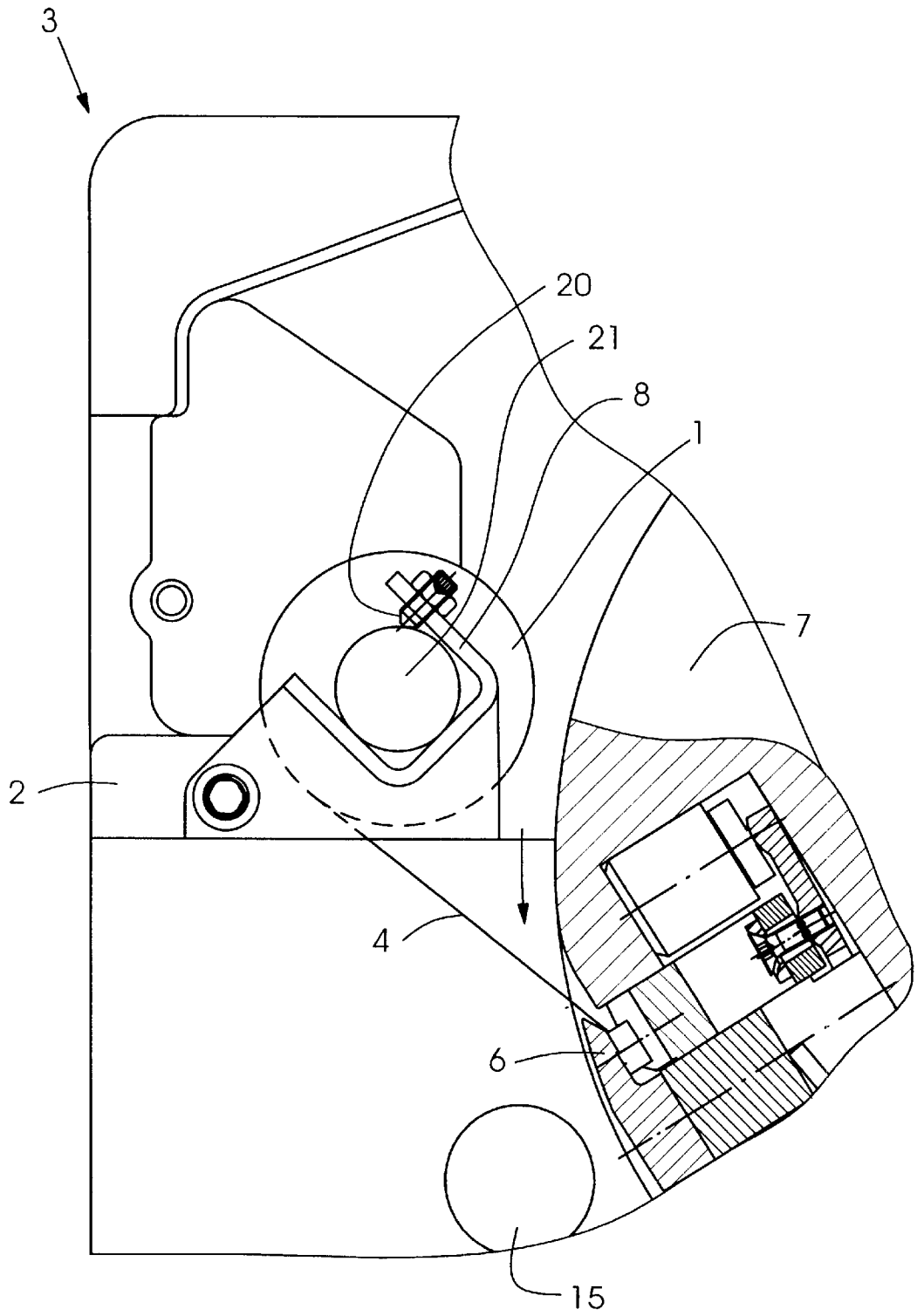
FIG. 2 is a view like that of FIG. 1 showing a container forming part of the device according to the invention, that is received in a frame of a printing unit.
Figure 3:
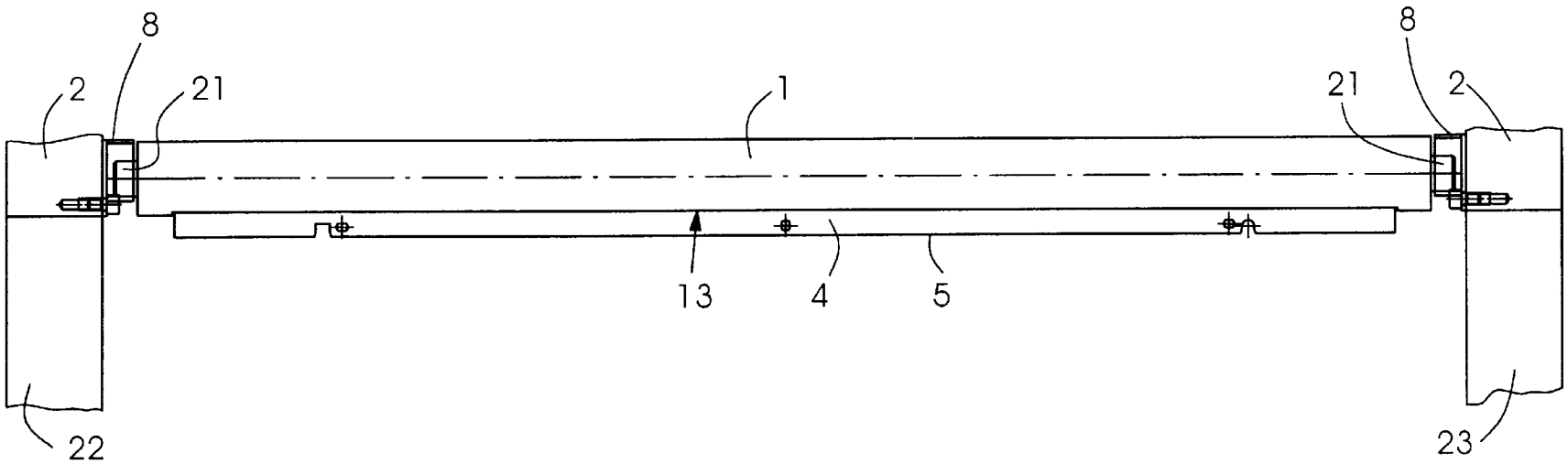
FIG. 3 is a much-reduced front elevational view of FIG. 2 showing the container mounted between the drive and the operating sides of the frame of the printing unit.

FIG. 2 shows how the container 1 is received in the frame 2 of a printing unit 3. Provided for this purpose is a receiving or holding device 8 of U-shaped construction located, as shown in FIG. 3, at both the drive side 22 and the operating side 23 of the frame 2 of the printing unit 3. The respective receiving devices 8 accordingly accommodates journals 21 which are attached to both sides of the container 1. Latches 20 can ensure the secure retention of the container 1 in the frame 2 of the printing unit 3.

FIG. 3 shows the mounting of the container 1 between the drive side 22 and the operating side 23. This figure also shows that the leading edge 5 of the printing plate 4 protrudes from the opening 13 after the container 1 has been installed, so that it is possible to grip this leading edge 5 and insert it into a leading-edge clamping device 6. Of course, however, it is also possible to automate this step, for example, by a device that draws the leading edge 5 a distance out of the container 1. Then, by rotating the plate cylinder 7 in a direction counter to that of the arrow 24 (note FIG. 2), the leading edge 5 of the printing plate 4 can be inserted into the open leading-edge clamping device 6. The leading-edge clamping device 6 then closes and the plate cylinder 7 rotates in the direction of the arrow 24 in order to take up the printing plate 4.

I claim:

1. A method of making-ready and feeding a printing form to a form cylinder of a printing machine, wherein at least one printing form is provided in a rolled-up state in a container and is unrolled so as to be fed to the form cylinder, which comprises:

replaceably positioning the container on a frame of a printing unit;

gripping the printing form, that is formed as a printing plate, at a leading edge thereof by a clamping device of the form cylinder, that is formed as a plate cylinder;

rotating the cylinder so as to apply the printing plate to the plate cylinder; and returning the printing plate into the containers after a print job has been completed.

2. A device for making-ready and feeding a printing form to a form cylinder of a printing machine, comprising:

a container for holding the printing form in a rolled-up state, the printing form being unrollable so as to be fed to the form cylinder, and for accommodating a printing plate therein after a print job has been performed, a receiving device for positioning said container on a frame of a printing unit so that a leading edge of the printing form formed as a printing plate is insertable into a clamping device of the form cylinder formed as a plate cylinder, the plate cylinder being rotatable for applying the printing plate to the plate cylinder, a shaft for accommodating the printing plate in said container being received in said container for gripping a trailing edge of the printing plate after the print job has been performed, and for drawing the printing plate back into said container; and a drive being connected to said shaft, said drive including a spring connected to said shaft, said spring being subjectible to tension when the printing plate is removed from said container, the printing plate being drawable back into said container by spring force after the printing job has been completed.

3. The device according to claim 2, including a rotatable guide element for guiding and pressing against the printing plate as the printing plate is being drawn onto the plate cylinder.

4. The device according to claim 3, wherein said rotatable guide element comprises two supporting rollers for pressing edge regions of the printing plate onto the plate cylinder.

5. The device according to claim 3, wherein said guide element is a roller for pressing the printing plate onto the plate cylinder.

6. The device according to claim 5, including elastic rings disposed at spaced distances from one another on said roller.

7. The device according to claim 3, wherein said guide element is automated for plate feeding and is engageable and disengageable automatically.

8. The device according to claim 2, wherein said shaft received is said container retainingly guides the trailing edge of the printing plate until the printing plate is removed from said container.

9. A device for making-ready and feeding a printing form to a form cylinder of a printing machine, comprising:

a container for holding a printing form in a rolled-up state, the printing form being unrollable so as to be fed to the form cylinder;

a receiving device for positioning said container on a frame of a printing unit so that a leading edge of a printing form formed as a printing plate is insertable into a clamping device of the form cylinder formed as a plate cylinder, the plate cylinder being rotatable for applying the printing plate to the plate cylinder;

another container for accommodating the printing plate therein after a print job has been performed;

a shaft for accommodating the printing plate in said other container being received in said other container for gripping a trailing edge of the printing plate after the print job has been performed, and for drawing the printing plate into the other container, and a drive connected to said shaft, said drive including a spring connected to said shaft, said spring being subjectible to tension when the printing plate is removed from said other container, the printing plate being drawable back into said other container by spring force after the print job has been completed.

* * * * *